US010222047B2

(12) United States Patent
Kadijk et al.

(10) Patent No.: US 10,222,047 B2
(45) Date of Patent: Mar. 5, 2019

(54) HEAT SINK FOR FORCED CONVECTION COOLER

(71) Applicant: PHILIPS LIGHTING HOLDING B.V., Eindhoven (NL)

(72) Inventors: Simon Eme Kadijk, Veldhoven (NL); Dirk Gehrels, Vught (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 48 days.

(21) Appl. No.: 15/500,538

(22) PCT Filed: Jul. 20, 2015

(86) PCT No.: PCT/EP2015/066504
§ 371 (c)(1),
(2) Date: Jan. 31, 2017

(87) PCT Pub. No.: WO2016/016024
PCT Pub. Date: Feb. 4, 2016

(65) Prior Publication Data

US 2017/0219198 A1 Aug. 3, 2017

(30) Foreign Application Priority Data

Jul. 31, 2014 (EP) ..... 14179321

(51) Int. Cl.
*F21V 29/67* (2015.01)
*F21V 29/78* (2015.01)
(Continued)

(52) U.S. Cl.
CPC ..... *F21V 29/673* (2015.01); *F21K 9/23* (2016.08); *F21V 29/503* (2015.01); *F21V 29/78* (2015.01); *F21Y 2115/10* (2016.08)

(58) Field of Classification Search
CPC ..... F21V 29/673; F21V 29/503; F21V 29/78; F21Y 2115/10
(Continued)

(56) References Cited

U.S. PATENT DOCUMENTS 7,055,577 B2 * 6/2006 Wang ..... H01L 23/467 165/185
8,262,255 B1 * 9/2012 Rashidi ..... F21V 29/505 362/249.02
(Continued)

FOREIGN PATENT DOCUMENTS

CN 10101693 * 8/2007
CN 101016983 A 8/2007

OTHER PUBLICATIONS

Translation of CN 101016983; Patent Translate; May 13, 2018; pp. 1-2.*

*Primary Examiner* — Laura Tso
(74) *Attorney, Agent, or Firm* — Akarsh P. Belagodu

(57) ABSTRACT

The invention relates to a heat sink (1) for cooling a heat source, the heat sink comprising a heat distributor (12) comprising a 3-dimensional body with a side wall (13) arranged around a main axis (14), and a plurality of plates (11) coupled to and extending from the side wall, each of the plurality of plates being curved in a cross section perpendicular to the main axis, wherein the plates are twisted along the main axis (14) of the heat distributor. The present invention solves the excessive fin length issue that is needed for higher values of the external diameter vs. the internal diameter of the fins section. The fins have curvature in all directions, which is referred to as double curvature. This double curvature is the result of two curving of each fin in a radial direction and twisting of the fins along the axial direction.

15 Claims, 7 Drawing Sheets

(51) Int. Cl.
*F21K 9/23* (2016.01)
*F21V 29/503* (2015.01)
*F21Y 115/10* (2016.01)

(58) Field of Classification Search
USPC ..... 362/294, 373
See application file for complete search history.

(56) References Cited

U.S. PATENT DOCUMENTS 8,475,015 B2 * 7/2013 Liu ..... F21V 15/01 313/46
2004/0261975 A1 * 12/2004 Kozyra ..... H01L 23/467 165/80.3
2005/0061478 A1 3/2005 Huang
2009/0141508 A1 * 6/2009 Peng ..... F21V 23/02 362/373
2010/0014287 A1 * 1/2010 Chiang ..... F21V 17/162 362/231
2010/0027258 A1 * 2/2010 Maxik ..... F21V 29/78 362/240
2010/0127637 A1 * 5/2010 Alexander ..... F21V 15/01 315/294
2011/0019409 A1 * 1/2011 Wronski ..... F21V 7/00 362/235
2011/0164420 A1 * 7/2011 Lee ..... F21K 9/00 362/249.02
2012/0140466 A1 * 6/2012 Yang ..... F21K 9/137 362/235
2012/0223640 A1 * 9/2012 Koplow ..... F04D 17/16 315/50
2013/0083546 A1 4/2013 Duan et al.

* cited by examiner

HEAT SINK FOR FORCED CONVECTION COOLER

CROSS-REFERENCE TO PRIOR APPLICATIONS

This application is the U.S. National Phase application under 35 U.S.C. § 371 of International Application No. PCT/EP2015/066504, filed on Jul. 20, 2015, which claims the benefit of European Patent Application No. 14179321.6, filed on Jul. 31, 2014. These applications are hereby incorporated by reference herein.

FIELD OF THE INVENTION

The invention relates to a heat sink, a forced convection cooler comprising such a heat sink, a lamp comprising such a forced convection cooler and a luminaire comprising said lamp.

BACKGROUND OF THE INVENTION

Today's electronic equipment may use a lot of electrical power. Many CPUs, GPUs or a LED PCBs actually behave like heat sources producing a lot of heat which needs to be eliminated to avoid damage and failure. One way of eliminating the produced heat is by forced convection cooling of the heat sources. A heat sink may be thermally coupled to the heat source, wherein the heat sink is cooled by blowing air along or through the heat sink. A particular category of heat sinks is the radial heat sink equipped with an axial fan. A radial heat sink comprises a central heat distributor connected to a plurality of radially extending fins. The axial fan is positioned so as to blow air between the fins. The fins will be cooled by the air, and therefore the heat distributor can distribute the heat coming from the heat source towards the fins. To obtain a satisfying result, the fins need to have a minimal length.

The required fin thickness increases strongly with the fin length (length from base to fin tip), according to a square relation as follows from the fin efficiency theory, which is well known under specialists in the thermal field. So it is desirable to keep the fin length as short as possible, for performance, weight and cost reasons.

Air flow from a fan may have a considerable speed (typically 2-10 m/s in consumer products) and deflection of the flow into another direction is associated with a pressure drop and loss of flow.

Publication US 2005/061478 A1 discloses a heat sink having a plurality of plates which are curved in a cross section perpendicular to a main axis. An example has been shown in which the plates are also curved in the axial direction.

SUMMARY OF THE INVENTION

It is an object of the invention to provide a radial heat sink that is used in conjunction with an axial fan that offers a solution for both the challenge of minimizing the fin length while at the same time minimizing the deflection of the air flow by the fins.

According to an aspect, there is provided a heat sink for cooling a heat source, the heat sink comprising a heat distributor comprising a 3-dimensional body with a side wall arranged around a main axis, and a plurality of plates coupled to and extending from the side wall, each of the plurality of plates being curved in a cross section perpendicular to the main axis, wherein the plates are twisted along the main axis of the heat distributor, and wherein a fin spacing, being a distance between two neighboring plates increases with an increasing radial location.

The plates have curvature in all directions, which is referred to as double curvature. This double curvature is the result of curvature of each plate in a radial direction and a twisting of the fins along the axial direction. Due to the double curvature, the plates can be designed in such a way that air coming from the axial fan will experience little resistance. Furthermore, by increasing the fin spacing towards the outside of the plates (i.e. fins) the air flowing in at a larger radial position will experience about equal hydraulic resistance as compared to air flowing in at smaller radial position. In this way the air flow will be more uniform and the temperature distribution across the plates is improved improving the overall efficiency of the heat sink.

In an embodiment, the side wall is line symmetrical around the main axis. The side wall may have for example a cylindrical or conical shape. These shapes are very suitable to arrange the specially curved fins onto. However, it is noted that other shapes are conceivable such as box-shaped heat distributors. The body of the heat distributor may a solid body being closed from the top and bottom side, but alternatively the body may be hollow and the top and/or bottom side may be open and alternatively, a heat pipe may be contained in the body of the heat distributor.

In the cross section perpendicular to the main axis, each plate may form a two-dimensional spiral. This spiral form together with torsion in the axial direction enables a heat sink designs with closed spaced fins, which can be aligned with air flow coming from an axial ventilator. Such alignment will optimize the air flow through the sink.

In an embodiment, in the cross section perpendicular to the main axis, each plate leaves the side wall of the heat distributor in a radial direction with respect to the main axis. As a result, given a plate thickness, the spacing between adjacent plates is optimal with radially orientation of the plates, leading to maximum openness of the heat sink for air flow.

Each plate may have at least three edges. In an embodiment, each plate has four edges wherein a first edge which is connected the side wall, forms a first helix having a first radius equal to an outer diameter of the heat distributor. A second edge lying opposite of the first edge, may also form a second helix having a second radius larger than the outer diameter of the heat distributor. This configuration results in a very smooth and structured configuration which can be tuned to the swirl of the air coming from an axial ventilator.

The twisting of the plates along the axial direction of the heat sink may be matched with the swirl of the axial fan that is mounted on top of it in order to get the lowest possible impedance for the coupling in of the air flow into the heat sink, leading to a low pressure drop and high air flow, and from that to the best thermal performance. Measurements have shown that in an axial fan significant deviations from the axial flow occur, which is also referred to as 'swirl'. Air velocity of particular fans may have a twist angle between 20-60 degrees, so the ideal heat sink for such fans should have fins that are in the same range of twist angle.

In an embodiment, the fin spacing linearly increases with an increasing radius starting from an inner radius of the plates. The linear relation has shown to give good efficiency results.

Preferably, the fin spacing at an outer radius of the plates is about 10% to 20% greater than the fin spacing at the inner radius of the plates. Under this condition the heating rate in axial direction of the flowing air can be independent of the radial position in the heat sink.

In an embodiment, a maximum value of the fin spacing is less than twice a minimum value of the fin spacing. Under this condition the hydraulic resistance for air flow in axial direction has a dependency on the radius which is within a reasonable range.

In an embodiment a twist of the plates of the heat sink, as specified as the number of full turns per meter is up to 0.28/r_outer, where r_outer is the outer radius of the heat sink. Under this condition the air flow entering the heat sink has an angle with the axial direction of maximum 60 degrees, this maximum is only at the outer radius of the heat sink, This 60 degrees angle is the expected maximum swirl angle of the air flow from the axial fan.

In an embodiment, the heat sink comprises an enclosure arranged around the heat sink fins, which enclosure fully or partially covers the fins in the radial direction, as a duct to guide the air flow in the axial direction.

According to a further aspect, there is provided a forced convection cooler comprising a heat sink as described above and an axial ventilator arranged to blow air through the fins.

According to a further aspect, there is provided a lamp comprising at least one light emitting device and a forced convection cooler as described above.

Further preferred embodiments of the heat sink according to the invention are given in the appended claims.

BRIEF DESCRIPTION OF THE DRAWINGS

These and other aspects of the invention will be apparent from and elucidated further with reference to the embodiments described by way of example in the following description and with reference to the accompanying drawings, in which.

The figures are purely diagrammatic and not drawn to scale. In the Figures, elements which correspond to elements already described may have the same reference numerals.

DETAILED DESCRIPTION OF EMBODIMENTS

Figure 1:
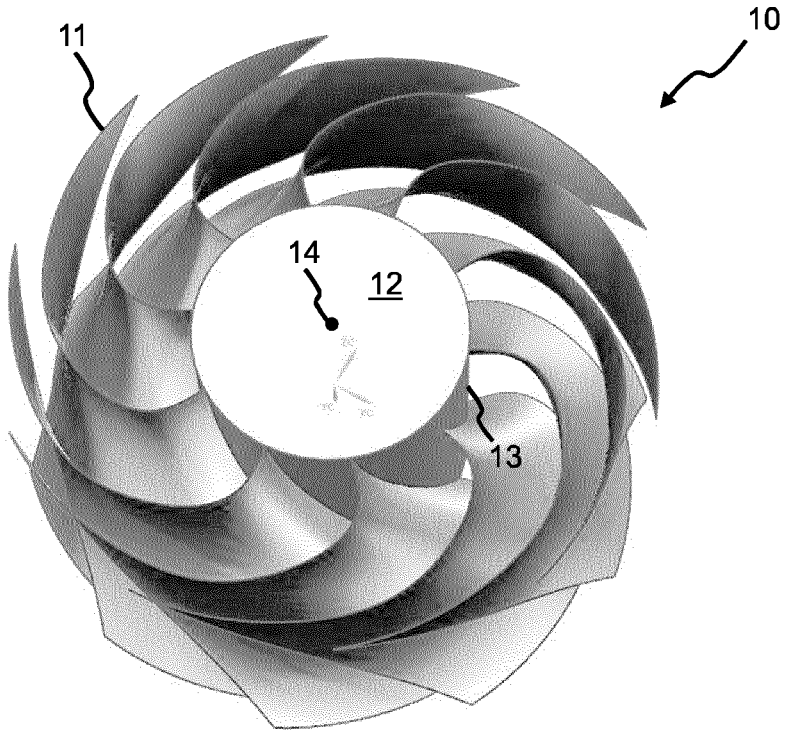
FIG. 1 is a perspective view of a heat sink according to an embodiment.
Figure 2:
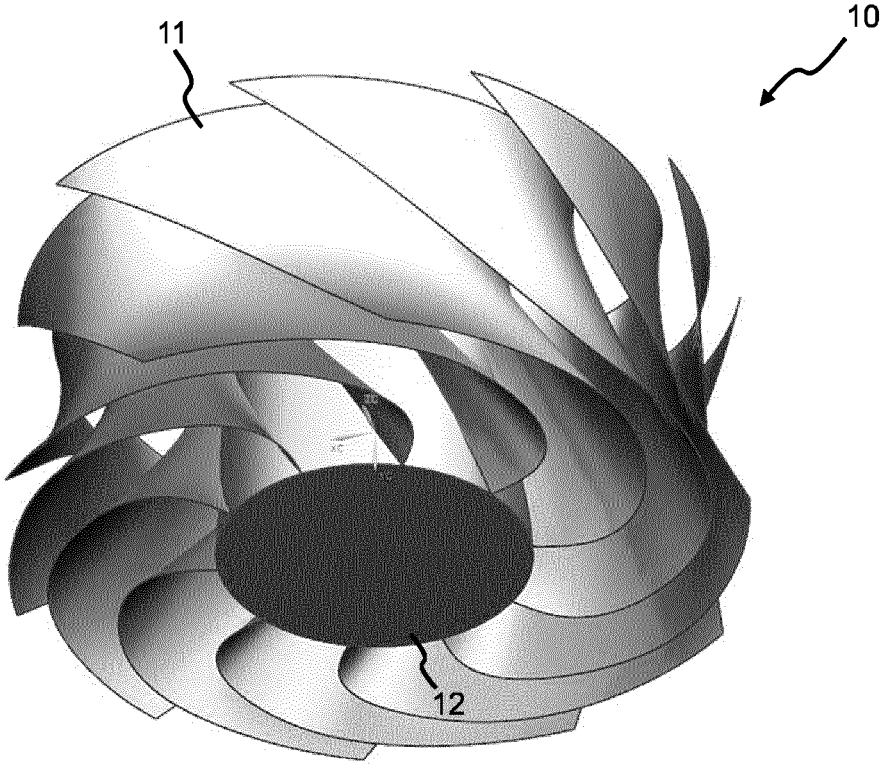
FIG. 2 shows the embodiment of FIG. 1 out of another perspective.

FIG. 1 is a perspective view of a heat sink according to an embodiment. In this embodiment a heat sink 10 comprises a plurality of plates 11 arranged around central heat distributor 12. The heat distributor 12 comprises a 3-dimensional body having a side wall 13 which is line symmetrical with respect to a main axis 14 of the heat distributor 12. In this embodiment, the heat distributor 12 is a cylindrical solid body made of a heat conductive material such as a metal. The plates 11 acting as cooling fins 11, also simply referred to as fins 11, may be made of the same material as that of the main body, or they may be made of another material that is also sufficiently conducts heat. As can be seen from FIG. 1, the fins 11 are arranged at the side wall 13 of the heat distributor 12 in a regular manner. In this embodiment each fin 11 comprises four edges, one of which is coupled to the side wall 13. Each fin 11 is curved in a cross section perpendicular to the main axis 14, as will be explained in more detail below. The fins 11 are also curved in other directions as if they were twisted along the main axis 14. In other words, the fins 11 arranged around the cylindrical heat distributor 12 all have a twist, also referred to as swirl. FIG. 2 shows the embodiment of FIG. 1, but from another 3D-perspective.

Figure 3:
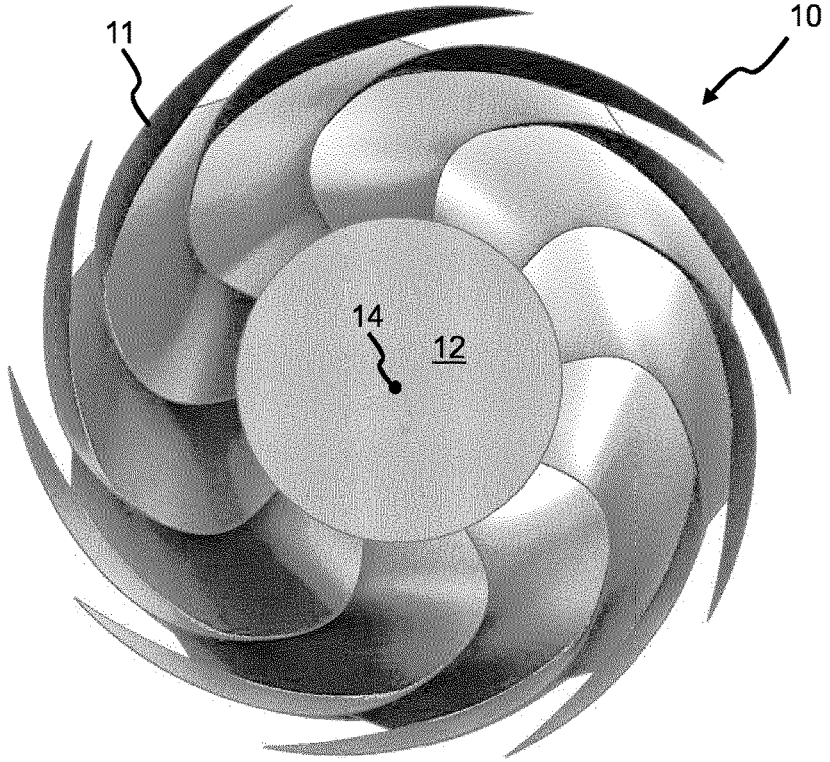
FIG. 3 shows a front side of the embodiment of FIG. 1.

FIG. 3 shows a front side of the embodiment of FIG. 1. In an embodiment of the invention, this front side of the heat sink 10 faces an axial fan (not shown) to embody a forced convection cooler. It is noted that the front side is also referred to as fan facing side. FIG. 3 also shows the main axis 14 which is the axis of symmetry of the heat distributor 12.

In an embodiment, the fins 11 are arranged symmetrically around the main axis 14. As can be seen from FIG. 3, each fin 11 leaves the heat distributor 12 in a radial direction, relative to the main axis 14.

In the embodiment of FIG. 3, each fin 11 has an increasing radius of curvature in a plane perpendicular to the main axis 14, which in FIG. 3 resembles the 2D-plane of the drawing. In other words, each of the fins 11 in a cross section perpendicular to the main axis 14 forms a spiral.

It is noted that other alternatives are possible with a configuration other than a spiral. For example, the curvature of the fins 11 in this cross section may be curved so that the fins continuously extend away from the side wall 13, without being exactly on a spiral.

Figure 4:
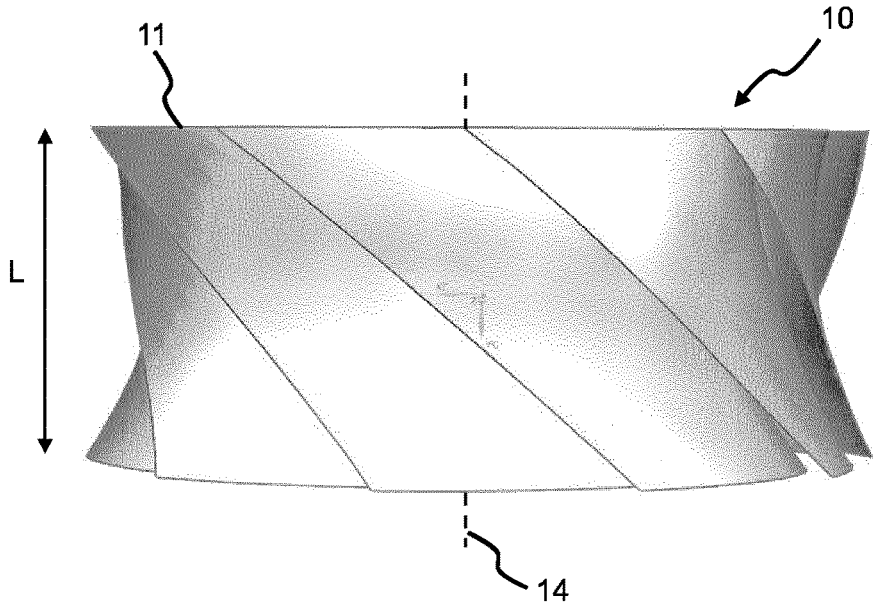
FIG. 4 shows a side view of the embodiment of FIGS. 1-3.

FIG. 4 shows a side view of the embodiment of FIGS. 1-3. In FIG. 4 it can be seen that although the outer edges of the fins in this embodiment all end on an imaginary cylinder having a length L, the side view of the heat sink 10 does not show a rectangle form. This is due to the specific form of the fins 11.

Figure 5:
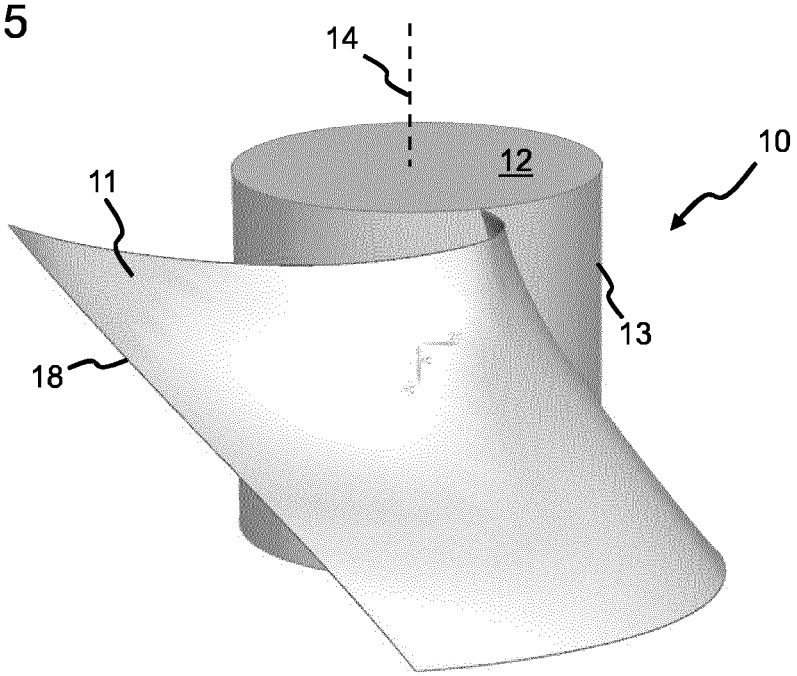
FIGS. 5 and 6 show perspective views of an embodiment of the heat sink having double curved fins wherein only one fin of the heat sink is shown.
Figure 6:
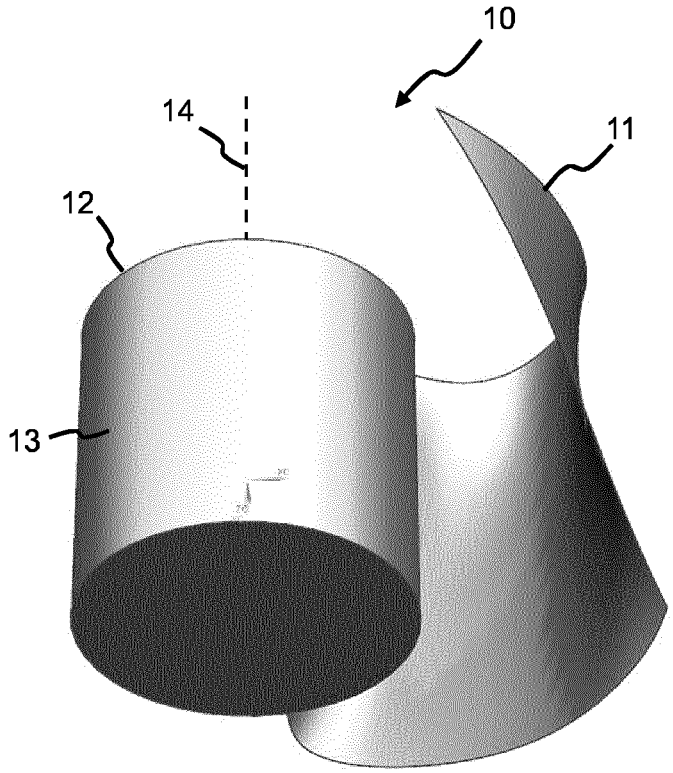

FIGS. 5 and 6 show an embodiment of the heat sink 10 having double curved fins 11, wherein only one fin 11 of the heat sink 10 is shown for clarity reasons. As is shown the fin 11 is coupled to the heat distributor 12 at a first edge, partly hidden in FIG. 5. This first edge forms a first helix having a first radius equal to an outer diameter of the heat distributor 12, i.e. of the side wall 13. As will be explained further in FIG. 8, the first helix has the property that a tangent line at any point makes a constant twist angle with the main axis 14. The twist angle may have different values, for example in the range of 20-60 degrees. In this example, an edge 18 opposite of the first edge also forms a helix, referred to as the second helix. The second helix has a twist angle, referred to as outer twist angle, which may have values in the range of 20-60 degrees, but will always be larger than the 'inner' twist angle.

The inventors have found that an axial fan very often produces an air flow with a swirl. An angle of incidence of the air flow produced by the fan can be measured using for example laser optical measurements. If the fins 11 of the heat sink 10, at a given distance from the main axis 14, have a twist angle that is similar to the twist angle of the measured swirl, the air flow resistance of the heat sink can be decreased.

Figure 7:
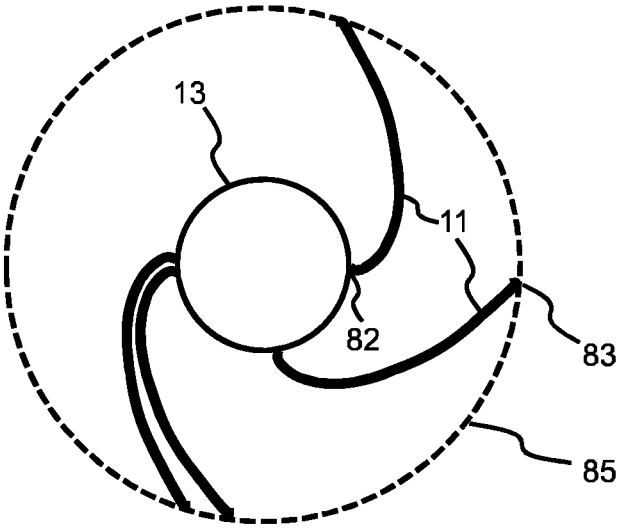
FIG. 7 shows a cross section of the side wall of the heat distributor and the fins perpendicular to the main axis.

FIG. 7 is a cross section of the heat sink perpendicular to the main axis according to an embodiment, showing the side wall 13 of the heat distributor 12 and some of the fins 11. As can be seen from FIG. 7, each fin 11 lies on (or forms) a spiral. The spirals all start at the side wall 13 and end on an imaginary circle 85 which is concentric relative to the (circular) outer wall 13. The heat sink may comprise an enclosure arranged around the heat sink fins 11, which enclosure fully or partially covers the fins in the radial direction. This enclosure may be arranged on the imaginary circle 85 or near the imaginary circle. The enclosure will avoid air from escaping the heat sink through the side.

Figure 8:
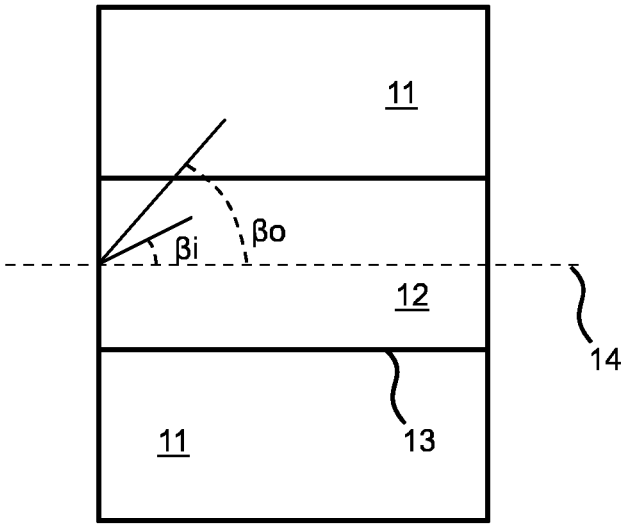
FIG. 8 shows a schematic side view of the heat sink according to an embodiment.

FIG. 8 shows a schematic side view of the heat sink according to an embodiment. In FIG. 8 two twist angles βi and βo are shown. In this example the inner twist angle βi is 20 degrees and the outer twist angle βo is 60 degrees. The twist angles are shown left side of the heat sink, but is should be noted that these angles are present in the helices of the side edges along the whole length of the main axis, i.e. along the complete length of the heat distributor 10. The inner twist angle βi is the angle of a tangent line along the first helix around the side wall 13, see location 82 in FIG. 7. The outer twist angle βo is the angle of a tangent line along the second helix, see location 83 in FIG. 7.

A possible approximate mathematical description of the fin profile as defined by the polar angle θ of the fins 11 in the radial direction r and the axial direction z can be formulated as follows:

$$\theta(r,z)=(i-1)*2\pi/n+b1*z/r1+a1*(r-r0)/r1+a2*((r-r0)/r1)^2+a3*((r-r0)/r1)^3+a4*((r-r0)/r1)^4+\ldots$$

with r0 the inner radius, r1 the outer radius, i an index referring to a specific fin, b1 being the degree of twist, a1, a2, a3, a4 profile parameters determining the amount of curvature in the plane perpendicular to the main axis.

The following table shows some typical values for the parameters mentioned above.

| | | |
|---|---|---|
| r0 (core radius) | m | 0.01 |
| r1 (outer radius) | m | 0.04 |
| i = fin number | | 1 |
| n = number of fins | | 26 |
| a1 | rad | 0.00 |
| a2 | rad | 5.00 |
| a3 | rad | −4.33 |
| a4 | rad | 1.11 |
| twist | turns/m | 7.0 |
| twist angle per meter | rad/m | 44.0 |
| b1 | rad | −1.76 |

In the above example a1=0 which means that the fins 11 are perpendicular to the side wall 13. The values for a2, a3 and a4 may result in almost identical profiles in different sets of configurations, so if a2 is chosen, then a3 and a4 can be used for profile optimization. If the value of a2 increases, the fin curvature increases and the fin length will increase as well.

It is noted that if the fins would only be curved in the radial direction and not in the axial (i.e. no twist in the fins), the path length from the entrance of the heat sink till the exit of the heat sink (referred to as air flow path length) would be the same for all values of the radial position r. However, in the double curved heat sink (i.e. with a twist) the air flow path is helical and will depend on the radial position r. Due to the twist, the air flow path at the outer side of the fins (i.e. at large values of r) may even be twice as large as that of air flowing in at the inner side (i.e. near the side wall 13).

In the following the fin spacing is defined as the distance between two neighboring fins looking in a direction perpendicular to one of the fin surfaces of neighboring fins.

Preferably, the fin spacing is slightly greater at the outer radius compared to the spacing at the inner radius. The maximum spacing is preferable less than twice the minimum spacing.

A suitable increase in fin spacing with radial position will result in an improved performance of the heat sink. An optimal performance is the heating rate in axial direction of the flowing air is independent of the radial position in the heat sink. By increasing the fin spacing from the inner radius to the outer radius, the difference is air flow path length mentioned above, is compensated for.

Preferably, the fin spacing is increased with the effective flow path length to the power of ¼. This may be realized when the fin spacing increases linearly with the radial position, under the condition that the fin spacing at the outer radius is about 10% to 20% greater than the fin spacing at the core.

Figure 9A:
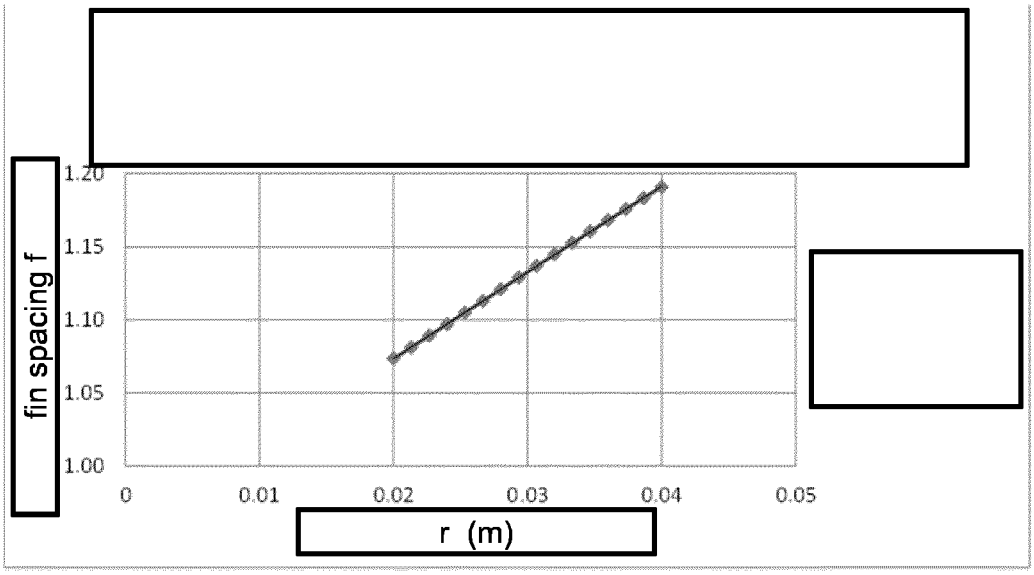
FIGS. 9A and 9B show two examples of targeted fin-to-fin distance f as a function of the radial position r.
Figure 9B:
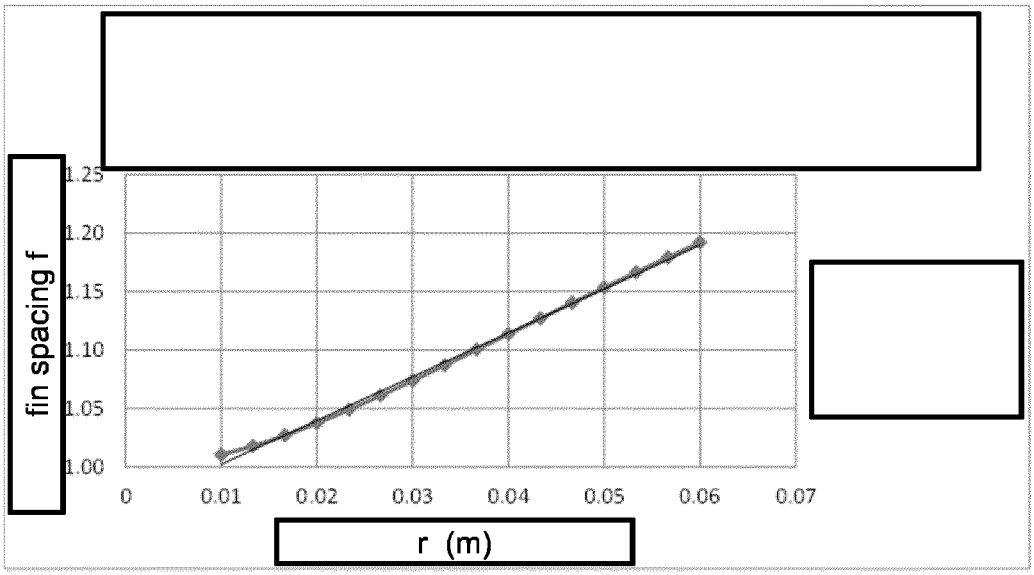

FIGS. 9A and 9B show two examples of targeted fin-to-fin distance f as a function of the radial position r. The connected dots in FIGS. 9A and 9B represent the targeted fin-to-fin distance f as a function of the radial position f, normalized to the distance that would be valid at the axis of symmetry. These targeted values lead to an optimum heating of the air that flows through the heat sink, meaning that heating up of the fins is independent of the radial position in any cross section perpendicular to the axis of the heat sink. In FIG. 9A the targeted fin-to-fin distance f is calculated for a heat sink with fins ranging from r_inner=0.02 m to r_outer=0.04 m. In FIG. 9B the targeted fin-to-fin distance f is calculated for a heat sink with fins ranging from r_inner=0.01 m to r_outer=0.06 m. The additional straight lines in FIG. 9A and FIG. 9B show that the targeted relative fin-to-fin distance is virtually linear with the radial position. In the example of FIG. 9A the linear relation is f=5.9058*r+0.9554, and in the example of FIG. 9B the relation is f=3.7524*r+0.9646.

In an embodiment, the twist of the heat sink, as specified in the number of full turns per meter is up to 0.28/r_outer, in which the r_outer is the outer radius of the heat sink. In this way the swirling motion of the air flow in the heat sink has an angle with the axial direction of maximum 60 degrees, this maximum is only at the outer radius of the heat sink.

It is noted that the obtained reduction in (double curved) fin length is typically 15% compared to the single curved fins, so the fin material volume can be reduced by using thinner fins, which is good for the thermal performance and the weight of the heat sink. The double curvature in fins makes sense for "long" fins in particular, where long is concerning the ratio of the outer radius over the inner radius of the fins. If the ratio is typically 2 or more, the double curvature is effective.

Figure 10A:
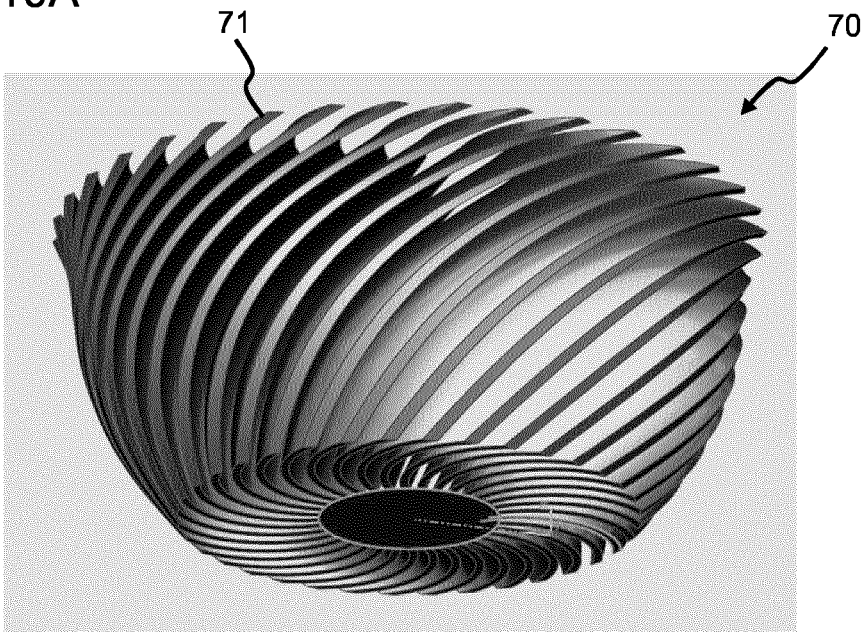
FIGS. 10A and 10B show perspective views of a heat sink according to a further embodiment, wherein outer ends of the fins form a substantially conical shape.
Figure 10B:
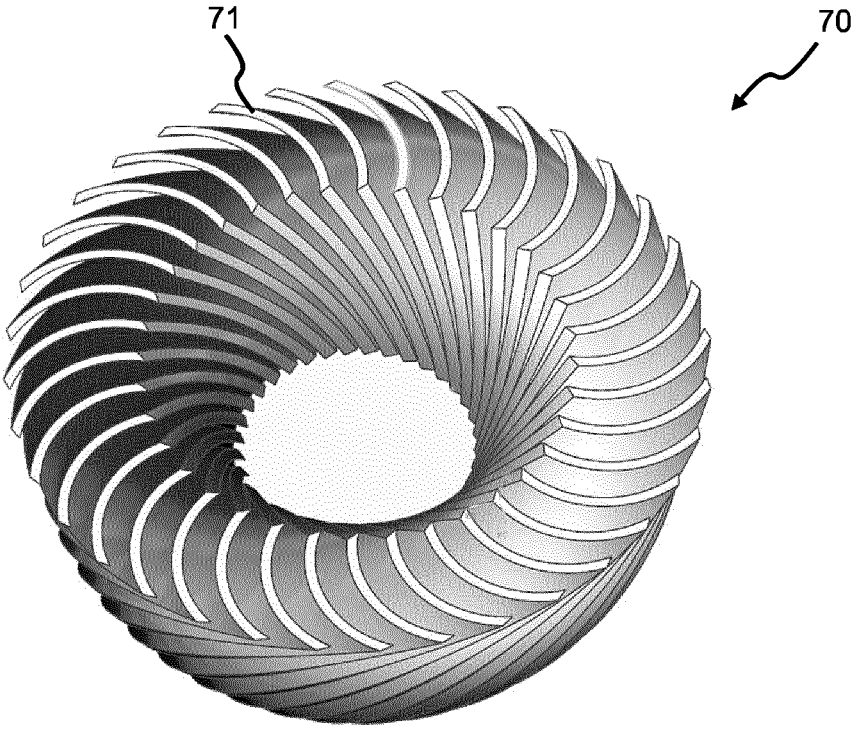

FIGS. 10A and 10B show perspective views of a heat sink 70 according to a further embodiment, wherein outer ends of the fins 71 form a substantially conical shape. A heat distributor (not shown) is located in the core of the heat sink 70, similar to the embodiments described with reference to FIGS. 1-6. The heat distributor in this embodiment may be substantially conical or cylindrical shaped. Other outer shapes are conceivable depending on the application.

Figure 11:
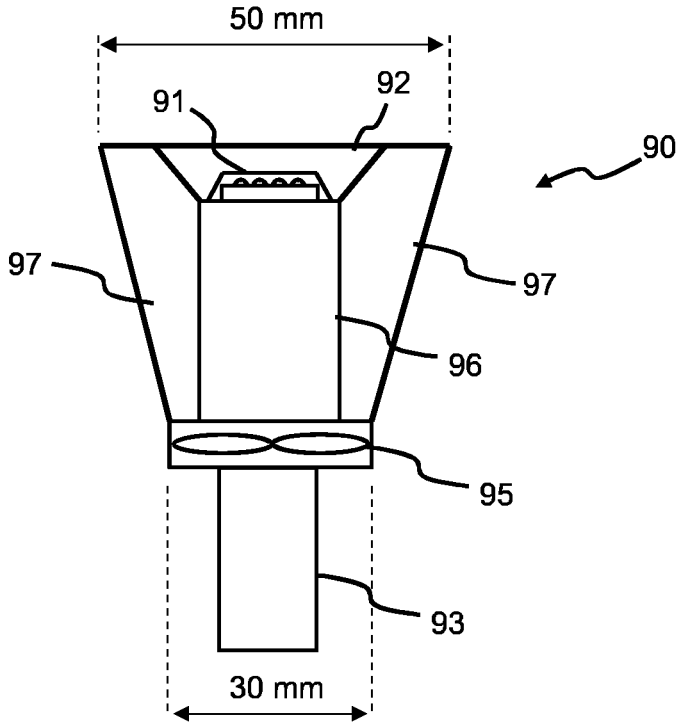
FIG. 11 shows a schematic cross section of a lamp according to an embodiment of the invention.

The above described embodiments of a heat sink may be used in a forced convection cooler. Such a cooler may comprise a heat sink as described above and an axial ventilator arranged to blow air through the fins. FIG. 11 shows a schematic cross section of a lamp 90 according to an embodiment of the invention. The lamp 90 comprises a light emitting device 91, an optical lens 92, a support rod 93 and a forced convection cooler. The forced convection cooler constitutes of a fan 95, a heat distributor 96 and a plurality of fins 97. The light emitting device 91 may be a LED module 91 producing light, but also producing heat and is thus acting as a heat source. The LED module 91 may be thermally coupled to the heat distributor 96 so that heat produced by the LED module 91 can be distributed to the cooling fins 97. In FIG. 11 typical values for the top and bottom dimensions of the lamp 90 are shown. Such relatively small dimensions are very suitable for all sorts of appliances.

To optimize the embodiments described above, a high thermal conductivity material can be chosen for the heat distributor and the fins, such as copper or aluminum. The total amount of 'extended surface', this is the fin area in practice, should be optimized given the constraints of the application. The required thickness is related to the length of the fin, the heat transfer coefficient and the material conductivity. In an embodiment, a fin thickness is in a range of 0.5-4 mm.

A typical value for the fin spacing lies in the range of 1-6 mm, wherein 1 mm is the lowest fin spacing that is believed not to get clogged by dust particles.

A proper alignment of the channels between the fins 97 with the flow from the fan 95 gives the lowest losses. Alignment of flow from the fan 95 with the fin structure for optimum coupling in of air flow can be achieved by alignment of the air flow direction of the air that leaves the fan in unconstrained operation with the channels that are formed by the fins 11 of the heat sink 10. In mathematical sense this means that the normal on the plane of the fins 11 has an angle close to 90 degrees with the unconstrained swirling air flow direction, or at least and angle that is greater than 60 degrees, such to minimize the alteration in the air flow direction from the fan into the heat sink.

Since in the described embodiment an air flow paths through the heat sink has no sharp bends, no disadvantageous pressure build up is caused.

As was mentioned above, the required fin thickness needs to be scaled with the fin length (length from base to fin tip), according to a square relation. By curving the fins in both the radial and the axial direction, the required fin length can be kept as short as possible, which is also favorable for weight and cost reasons.

The double curved fins cannot, or not easily, be manufactured with conventional technologies, such as die-casting. However, the inventors have found that additive manufacturing or printing can advantageously be used to build up the described embodiments. Such technologies are, for example, direct metal laser sintering, selective laser sintering, electron beam melting, fused deposition modeling, 3d printing based on extrusion and additive manufacturing based on using arc wires. In general, in an additive manufacturing technology, the component is build up in layers. Subsequently, when such additive manufacturing technologies are used, one can easily optimize the shape of the heat sink.

Figure 12:
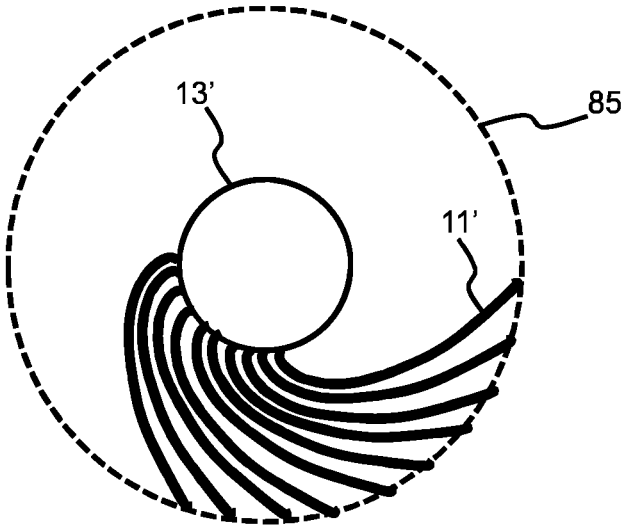
FIG. 12 shows an example of a pattern for printing a layer of the heat sink using a 3D printing technique.

FIG. 12 shows an example of a pattern for printing a layer of the heat sink using a 3D printing technique. The heat sink may be manufactured by printing subsequent layers of metal or other material. Each layer may have a pattern as shown in FIG. 12, in which a heat distributor wall pattern 13' and only a limited number of the fin patterns 11' are shown. A subsequent layer will have the same pattern but will be printed slightly rotated relative to a previous layer. By rotating the pattern for each subsequent layer the heat sink will get a twisted or helical form in the axial direction. The degree of torsion will be determined by the relative degree of rotation of a printed layer with respect to a previous printed layer.

A luminaire (also referred to as a light fixture) comprises one lamp and may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, LCD backlighting and air or water purification systems. In other embodiments the luminaire comprises multiple lamps.

The above described embodiments relate to a radial heat sink with a central core as heat spreader (i.e. heat distributor) and with double curved fins that can be aligned with the swirling air flow ejected by an axial fan mounted on top of the heat sink. Such an alignment has a low coupling-in impedance for air flow as the angle of incidence of the air flow is similar to the twist angle of the heat sink. The fins are twisted (i.e. torsion of the heat sink) as well as having curvature in a plane perpendicular to the main axis 14, in such a way that the targeted fin spacing can be obtained at a short fin length, leading to an increased cooling performance in such forced convection coolers.

The embodiments described above can be used in e.g. compact coolers for LED spot lamps, or CDM spot lamps and/or Retrofit spot lamps. It is noted that the heat sink and the cooler can alternatively be used to cool CPUs, GPUs, or other heat dissipation electronic components.

It is noted, that in this document the word 'comprising' does not exclude the presence of other elements or steps than those listed and the word 'a' or 'an' preceding an element does not exclude the presence of a plurality of such elements, that any reference signs do not limit the scope of the claims. Further, the invention is not limited to the embodiments, and the invention lies in each and every novel feature or combination of features described above or recited in mutually different dependent claims.

The invention claimed is:

1. A heat sink for cooling a heat source, the heat sink comprising:

a heat distributor comprising a 3-dimensional body with a side wall arranged around a main axis;

a plurality of plates coupled to and extending from the side wall, each of the plurality of plates being curved in a cross section perpendicular to the main axis, wherein each of the plates has a first edge connected to the side wall and the first edges of the plates are each twisted circumferentially about the side wall as the first edge travels in a direction along the main axis of the heat distributor, and wherein a fin spacing, being a distance between two neighboring plates, linearly increases with an increasing radial position starting from an inner radius of the plates, wherein the side wall has a cylindrical or conical shape, and wherein in a plane of the cross section perpendicular to the main axis, each plate forms a two-dimensional spiral.

2. Heat sink according to claim 1, wherein in the cross section perpendicular to the main axis, each plate leaves the side wall of the heat distributor in a radial direction with respect to the main axis.

3. Heat sink according to claim 1, wherein each plate has at least three edges, and wherein the first edge forms a first helix or conical spiral having a first radius equal to an outer diameter of the heat distributor.

4. Heat sink according to claim 3, wherein each plate has four edges, and wherein a second edge lying opposite of the first edge, forms a second helix having a second radius larger than the outer diameter of the heat distributor.

5. Heat sink according to claim 3, wherein each plate has four edges, and wherein a second edge lying opposite of the first edge, forms a second conical spiral.

6. Heat sink according to claim 1, wherein the fin spacing at an outer radius of the plates is about 10% to 20% greater than the fin spacing at the inner radius of the plates.

7. Heat sink according to claim 1, wherein a maximum value of the fin spacing is less than twice a minimum value of the fin spacing.

8. Heat sink according to claim 1, wherein a twist of the plates of the heat sink, as specified as the number of full turns per meter is up to 0.28/r_outer, where r_outer is the outer radius of the heat sink.

9. Heat sink according to claim 1, wherein the heat sink further comprises an enclosure arranged around the heat sink fins, which enclosure fully or partially covers the fins in the radial direction.

10. A forced convection cooler comprising a heat sink according to claim 1, and an axial ventilator axially aligned with the heat sink and arranged to blow air through the plates.

11. A lamp comprising at least one light emitting device and a forced convection cooler according to claim 10.

12. Lamp according to claim 11, wherein the light emitting device is a light emitting diode.

13. A luminaire comprising at least one lamp according to claim 11.

14. A heat sink for cooling a heat source, the heat sink comprising:

a heat distributor comprising a 3-dimensional body with a side wall arranged around a main axis;

a plurality of plates coupled to and extending from the side wall, each of the plurality of plates being curved in a cross section perpendicular to the main axis, wherein the plates are twisted along the main axis of the heat distributor, and wherein a fin spacing, being a distance between two neighboring plates, linearly increases with an increasing radial position starting from an inner radius of the plates;

wherein the side wall has a cylindrical or conical shape, and wherein in the cross section perpendicular to the main axis, each plate forms a two-dimensional spiral;

wherein each plate has four edges, and wherein a first edge which is connected the side wall, forms a first helix or conical spiral having a first radius equal to an outer diameter of the heat distributor; and wherein a second edge lying opposite of the first edge, forms a second helix having a second radius larger than the outer diameter of the heat distributor.

15. A heat sink for cooling a heat source, the heat sink comprising:

a heat distributor comprising a 3-dimensional body with a side wall arranged around a main axis;

a plurality of plates coupled to and extending from the side wall, each of the plurality of plates being curved in a cross section perpendicular to the main axis, wherein the plates are twisted along the main axis of the heat distributor, and wherein a fin spacing, being a distance between two neighboring plates, linearly increases with an increasing radial position starting from an inner radius of the plates;

wherein the side wall has a cylindrical or conical shape, and wherein in the cross section perpendicular to the main axis, each plate forms a two-dimensional spiral;

wherein each plate has four edges, and wherein a first edge which is connected the side wall, forms a first helix or conical spiral having a first radius equal to an outer diameter of the heat distributor; and wherein a second edge lying opposite of the first edge, forms a second conical spiral.

* * * * *